US008844622B2

(12) United States Patent
Telfer

(10) Patent No.: US 8,844,622 B2
(45) **Date of Patent: *Sep. 30, 2014**

(54) WELLBORE CLEANING METHOD AND APPARATUS

(71) Applicant: Specialised Petroleum Services Group Limited, Aberdeen (GB)

(72) Inventor: George Telfer, Aberdeen (GB)

(73) Assignee: Specialised Petroleum Services Group Limited, Aberdeen (GB)

( * ) Notice: Subject to any disclaimer, the term of this patent is extended or adjusted under 35 U.S.C. 154(b) by 0 days.

This patent is subject to a terminal disclaimer.

(21) Appl. No.: 13/854,637

(22) Filed: Apr. 1, 2013

(65) Prior Publication Data

US 2013/0220596 A1 Aug. 29, 2013

Related U.S. Application Data

(62) Division of application No. 11/994,486, filed as application No. PCT/GB2006/002389 on Jun. 29, 2006, now Pat. No. 8,408,307.

(30) Foreign Application Priority Data

Jul. 2, 2005 (GB) ..... 0513645.2

(51) Int. Cl.

| | |
|---|---|
| ***E21B 37/00*** | (2006.01) |
| ***E21B 23/00*** | (2006.01) |
| ***E21B 37/04*** | (2006.01) |
| ***E21B 37/02*** | (2006.01) |
| ***E21B 21/10*** | (2006.01) |
| *E21B 34/00* | (2006.01) |

(52) U.S. Cl.

CPC ..... *E21B 37/04* (2013.01); *E21B 2034/007* (2013.01); *E21B 23/006* (2013.01); *E21B 37/02* (2013.01); *E21B 21/103* (2013.01)

USPC ..... 166/170; 166/173; 166/311

(58) Field of Classification Search

USPC ..... 166/311, 170–175, 331; 175/325.1, 175/325.5, 328

See application file for complete search history.

(56) References Cited

U.S. PATENT DOCUMENTS 2,811,210 A 10/1957 Guillot
3,376,935 A * 4/1968 Baker ..... 166/317

(Continued)

FOREIGN PATENT DOCUMENTS

GB 2274321 A 7/1994
GB 2327963 A 2/1999

(Continued)

OTHER PUBLICATIONS

International Search Report for PCT/GB2006/002389 mailed Dec. 21, 2006 (6 pages).

(Continued)

*Primary Examiner* — Sean Andrish
(74) *Attorney, Agent, or Firm* — Osha Liang LLP

(57) ABSTRACT

A method of drilling and cleaning a wellbore includes providing a drill string having a drill bit and a cleaning tool with selectively activatable cleaning members; drilling a wellbore using the drill bit while maintaining the cleaning members in a deactivated position; and pulling the drill string from the wellbore with the cleaning members in an activated position, to thereby clean the wellbore. A corresponding cleaning tool includes a body having a bore running therethrough, a sleeve located within the bore, the sleeve including a ball seat and the sleeve being biased in a first direction, and a plurality of selectively activatable cleaning members mounted for repeated movement relative to the body between activated and deactivated positions.

17 Claims, 6 Drawing Sheets

(56) References Cited

U.S. PATENT DOCUMENTS

| | | | | |
|---|---|---|---|---|
| 4,671,355 | A | 6/1987 | Strange | |
| 7,735,547 | B2 * | 6/2010 | Telfer | 166/66.5 |
| 2002/0005284 | A1 | 1/2002 | Allen | |
| 2004/0134687 | A1 * | 7/2004 | Radford et al. | 175/57 |

FOREIGN PATENT DOCUMENTS

| | | | |
|---|---|---|---|
| GB | WO 03/036014 | * | 5/2003 |
| GB | 2391884 A | | 2/2004 |
| WO | 0077339 A1 | | 12/2000 |
| WO | 0166907 A1 | | 9/2001 |
| WO | 03093635 A1 | | 11/2003 |
| WO | 2004/097163 A1 | | 11/2004 |

OTHER PUBLICATIONS

Written Opinion of International Searching Authority for PCT/GB2006/002389 mailed Dec. 21, 2006 (8 pages).

Office Action issued in corresponding Canadian Application No. 2,612,092 dated Jul. 10, 2013 (2 pages).

* cited by examiner

WELLBORE CLEANING METHOD AND APPARATUS

CROSS REFERENCE TO RELATED APPLICATIONS

This application is a divisional application and claims benefit under 35 U.S.C. §120 to U.S. patent application Ser. No. 11/994,486, filed Jan. 2, 2008, issued as U.S. Pat. No. 8,408,307, on Apr. 2, 2013, which claims priority, pursuant to 35 U.S.C. §119(e), to PCT Application No. PCT/GB2006/002389, filed Jun. 29, 2006 and Great Britain Application No. 0513645.2, filed Jul. 2, 2005. All of these applications are incorporated by reference in their entirety.

BACKGROUND

The present invention relates to well cleaning methods and apparatus. In particular, but not exclusively, the present invention relates to a method of drilling and cleaning a wellbore.

In the drilling and production of oil and gas wells, it is typical to provide a drill string which is terminated by a drill bit. The drill string is rotated to remove formation ahead of the drill bit, to drill and thus form a wellbore, and to increase the depth of the well. Drilling mud or other fluid is pumped through the drill string to cool the drill bit, and to aid the passage of drill cuttings from the base of the well to the surface, via an annulus formed between the drill string and the wall of the wellbore.

At fixed intervals, the drill bit is removed from the wellbore and a casing comprising lengths of tubular casing sections coupled together end-to-end is run into the drilled wellbore and cemented in place. A smaller dimension drill bit is then inserted through the cased wellbore, to drill through the formation below the cased portion, to thereby extend the depth of the well. A smaller diameter casing is then installed in the extended portion of the wellbore and also cemented in place. If required, a liner comprising similar tubular sections coupled together end-to-end may be installed in the well, coupled to and extending from the final casing section. Once the desired full depth has been achieved, the drill string is removed from the well and then a work string is run-in to clean the well. Once the well has been cleaned out, the walls of the tubular members forming the casing/liner are free of debris so that when screens, packers, gravel pack assemblies, liner hangers or other completion equipment is inserted into the well, an efficient seal can be achieved between these devices and the casing/liner wall.

The step of cleaning the wellbore is usually achieved by inserting a work string containing dedicated well clean-up or cleaning tools. Typical well cleaning tools known for use in this environment include scrapers, wipers and/or brushes which are held against the internal wall of the casing/liner, to clean away debris as the tool is run-in and then pulled out of the wellbore. While this process is effective in cleaning the wellbore, it adds a significant amount of time to the job of preparing the well for production, since a separate well clean-up string requires to be run in the bore after the drill string has been removed. Additionally, the speed at which the string can be run-in and pulled from the well is relatively low, due to the required constant frictional contact between the cleaning members and the casing/liner wall.

Additionally, the formation in the wellbore is left exposed during the clean-up operation, and there are known disadvantages in leaving a formation exposed between drilling and completion of a well.

One known type of cleaning apparatus is disclosed in UK Patent Publication No. 2327963 (Appleton et al). GB2327963 describes a work string combining a packer with a scraper. The scraper is used to clean the casing ahead of the packer so that the packer can be set against a debris free casing. While this method removes the requirement of running a separate clean-up string before the packer is inserted, such a string is limited in that the scraper can only clean a fixed distance ahead of the packer and, as a result, only a portion of the casing is cleaned. Also, the debris removed is pushed into the wellbore.

SUMMARY

It is amongst the objects of at least one embodiment of the present invention to obviate or mitigate at least one of the foregoing disadvantages.

It is also amongst the objects of at least one embodiment of the present invention to provide a method of drilling a well wherein the well may be selectively cleaned as the drill string is pulled out of the wellbore.

It is further amongst the objects of at least one embodiment of the present invention to provide a cleaning tool for mounting on a drill string, the tool arranged to selectively provide a cleaning action upon completion of drilling in the well.

According to a first aspect of the present invention, there is provided a method of drilling and cleaning a wellbore, the method comprising the steps of:

a) providing a drill string having a drill bit and a cleaning tool with selectively activatable cleaning members;
b) drilling a wellbore using the drill bit while maintaining the cleaning members in a deactivated position; and
c) pulling the drill string from the wellbore with the cleaning members in an activated position, to thereby clean the wellbore.

By providing cleaning members on the drill string, and by activating the cleaning members as the drill string is removed, the wellbore may be cleaned as the drill bit is removed from the well. Thus the steps of drilling and cleaning may be achieved on a single trip into the wellbore, and the method may therefore be a method of drilling and cleaning a wellbore on a single trip. Additionally, running the cleaning tool in a deactivated configuration (with the cleaning members in their deactivated positions) while the drilling operation is carried out may prevent the cleaning members interfering with the drilling operation, so that, for example, the circulation of fluid and cuttings up the wellbore can be maintained.

The method may include the further step of deactivating the cleaning members, and thus of moving the cleaning members to their deactivated positions, after they have cleaned a portion of the wellbore. In this way, a selected portion or portions of the wellbore can be cleaned and the cleaning members returned to deactivated positions, for example, so that a further downhole operation may be carried out, or to avoid damaging other downhole components. The cleaning members may be repeatedly activated and deactivated in a cyclic manner as the string is removed from the wellbore. In this way, the cleaning members can be retracted as they pass over any elements such as nipples or seals which may otherwise be damaged by the cleaning members.

The method may include the step of urging and/or biasing the cleaning members into contact with a wall of the wellbore, and may comprise urging and/or biasing the cleaning members radially outwardly. In this way the cleaning tool may effectively clean the walls of a casing/liner (or other tubulars in the wellbore) of different diameters as the string is pulled from the wellbore. The cleaning members may be biased outwardly relative to a body of the cleaning tool.

The cleaning members may be biased into contact with the wall of the wellbore by magnetic repulsion. This may be achieved by moving a magnet provided on or in a sleeve of the cleaning tool from a position out of axial and/or rotational alignment with a corresponding magnet on or in each cleaning member, to a position in axial and/or rotational alignment with the magnet on or in each cleaning member. The magnets may be arranged in pole-to-pole opposition (S-S or N-N) such that, on alignment, the magnet on or in each cleaning member is urged outwardly, to move the cleaning member into contact with the wellbore wall.

Alternatively, the cleaning members may be mechanically biased into contact with the wall of the wellbore, for example, by a biasing spring. In a further alternative, the cleaning members may be biased into contact with the wall of the wellbore mechanically and by magnetic repulsion, and thus by a combination of a mechanical and a magnetic biasing force or load.

The step of cleaning the wellbore may include the step of scraping the wellbore. Advantageously the cleaning members are therefore scrapers.

The method may further include the step of dropping an activating element/obturating member such as a ball, plug or like object through the drill string to activate the cleaning members and thus to selectively move the cleaning members to their activated positions.

The method may also include the step of ejecting the ball from the cleaning tool once the cleaning members are activated and maintained circulation through the drill string during the cleaning operation.

Advantageously the method may further include the step of opening a port in the cleaning tool, which may be a radial port, and jetting cleaning fluid from the tool. In this way the casing/liner wall can be washed clean of debris which has been dislodged by the cleaning members.

It will be understood that a wellbore is typically drilled to a first depth and, as described above, a casing is then installed in the wellbore and cemented in place. The invention may have a particular utility in extending a wellbore which has been drilled to a first depth and in which a casing has been installed, by facilitating drilling of an extension of the wellbore, and subsequent cleaning of the existing casing when the string is pulled from the wellbore. It will equally be understood that, following location of a further, smaller diameter casing in the extended portion of the wellbore and cementing in place, the invention may have a particular utility in further extending the wellbore and cleaning of said smaller diameter casing on pulling out of the wellbore, and so on for further extended sections.

According to a second aspect of the present invention, there is provided a downhole cleaning tool for use on a drill string in a wellbore, the tool comprising:

a body having a bore running therethrough;

a sleeve located within the bore, the sleeve including a ball seat and the sleeve being biased in a first direction; and a plurality of cleaning members mounted for movement relative to the body between activated and deactivated positions;

wherein location of a ball on the ball seat facilitates movement of the sleeve in a second direction opposite to said first direction, to in turn facilitate movement of the cleaning members to their activated positions where they contact a wellbore wall.

The cleaning tool may comprise mechanical biasing means for biasing the sleeve in said first direction, and the mechanical biasing means may be located between the sleeve and the body.

The cleaning members may be located through the body and may be located in apertures extending through a wall of the body. The apertures may open onto the body bore.

The tool may be adapted to be actuated by inserting a ball into the body bore, the ball passing into and along the bore in a reverse direction (relative to said first direction).

In a preferred embodiment of the invention, the sleeve is movable relative to the body between a first axial position in which the cleaning members are in their respective deactivated positions, and a further axial position in which the cleaning members are in their respective activated positions. Location of a ball on the sleeve ball seat may serve for moving the sleeve between the first and further axial positions, to thereby move the cleaning members to their respective activated positions. The sleeve may be movable relative to the body in said second axial direction, from the first axial position to an intermediate axial position, during movement from the first axial position to the further axial position. The first axial position may be a first deactivated axial position, where the cleaning members are in their deactivated positions. The intermediate axial position may be a second deactivated position, where the cleaning members remain deactivated. The further axial position may be an activated axial position, where the cleaning members are in their activated positions. The sleeve may be biased for movement from the intermediate axial position towards the further axial position. This may be achieved by blowing the ball through or past the ball seat, and/or by reducing the pressure felt by the ball, and thus by reducing the fluid pressure force on the sleeve.

The sleeve may be mounted for axial and/or rotational movement relative to the body, to facilitate movement of the sleeve between the first and further axial positions. The tool may further comprise engagement means to control relative movement between the sleeve and the body. The engagement means may comprise a track or profiled groove provided on or in one of the sleeve and the body, and at least one follower or index pin on or in the other one of the sleeve and the body. The engagement means may comprise an indexing member, such as a sleeve, mounted for rotational movement relative to the sleeve but restrained against axial movement relative to the sleeve. The indexing member may define the track. The follower may be engaged within the track to facilitate control of movement of the sleeve relative to the body. The track may extend at least part way around a surface of the respective one of the sleeve and the body.

Advantageously, the track extends around an entire perimeter or circumference of the respective one of the sleeve and the body and, in this way, the cleaning members and thus the tool may be cycled between the activated and deactivated positions continuously/repeatedly. The track may comprise a plurality of detent positions spaced around the surface of the respective one of the sleeve and the body, and may comprise at least one detent position corresponding to each axial position of the sleeve relative to the body. For example, the track may comprise at least one first detent position corresponding to the first axial position of the sleeve relative to the body; at least one intermediate detent position corresponding to the intermediate axial position of the sleeve relative to the body; and at least one further detent position corresponding to the further axial position of the sleeve relative to the body.

The cleaning tool may comprise actuating means for moving the cleaning members between the activated and deactivated positions. The actuating means may be operatively associated with the sleeve such that movement of the sleeve in said second direction may facilitate operation of the actuating means and thus movement of the cleaning members from their deactivated to their activated positions. The actuating means may be provided upon/mounted on the sleeve. The actuating means may be adapted to move the cleaning members to their activated positions on movement of the sleeve towards the further sleeve axial position.

The actuating means may comprise or take the form of a cam, cam surface or ramp which may be provided on or in the sleeve and which may be inclined relative to a main axis of the tool. The cam surface may be moveable, with the sleeve, relative to the body and thus relative to the cleaning members, for moving the cleaning members to their activated positions, and may be adapted to force the cleaning members outwardly from the body. The cam surface may be movable to a position where the cam surface is located under or inwardly of the cleaning members, to move the cleaning members to their activated positions. Reverse movement of the cam surface may allow the members to retract to their deactivated positions. Retraction means may be provided to assist this. Such retraction means may include at least one spring or magnet.

The cleaning members may be radially biased to improve contact with the casing wall. The cleaning members may be biased by springs such as linear expanders or flat wave springs. Advantageously however, the members may be biased by magnetic levitation/repulsion, the cleaning member having a first magnet and the sleeve having a second magnet, and wherein on axial and/or rotational alignment of the magnets, mutual magnetic repulsion may bias and thus urge the first magnet away from the second.

The cleaning members may be physically restrained to/relative to the body. This may be by bolts arranged through apertures in the members. The apertures may provide for movement of the members between the activated and deactivated positions and/or the radially biased position, relative to the body.

The ball seat may be adapted to releaseably retain the ball. The ball seat may be made of a deformable/compressible material, and may be of a thermoplastic polymer such as PEEK (polyetheretherketone), or another thermoplastic polymer with suitable properties. In this fashion, the ball seat may be deformed when a sufficient fluid pressure is exerted on the ball, which may cause deformation of the ball seat and passage of the ball through or past the seat. Following passage of the ball through or past the ball seat, the seat may thus return to its original, undeformed dimensions. Alternatively, the ball may be deformable.

The tool may include a ball catcher at an end of the tool. The ball catcher may comprise a substantially cylindrical body having first and second bores running in parallel therethrough, wherein a ball entering the catcher is directed into the first bore so that the second bore remains open for the continuous passage of fluid through the tool. Advantageously the second bore is centrally located and aligned with the axial bore, which may itself be a central bore.

The body may include at least one port extending therethrough, which may be a radial port and which may facilitate discharge of fluid radially from the tool. The flow of fluid through the at least one port may be controlled by the sleeve, and thus movement of the sleeve may serve to open and close said port. In particular, when the sleeve is in said further axial position, relative to the body (where the cleaning members are in their activated positions), the at least one radial port may be open for the passage of fluid through the ports.

According to a third aspect of the present invention, there is provided a drill string comprising:

a drill bit; and a downhole cleaning tool comprising a body having a bore running therethrough; a sleeve located within the bore, the sleeve including a ball seat and the sleeve being biased in a first direction; and a plurality of cleaning members mounted for movement relative to the body between activated and deactivated positions; wherein location of a ball on the ball seat facilitates movement of the sleeve in a second direction opposite to said first direction, to in turn facilitate movement of the cleaning members to their activated positions where they contact a wellbore wall.

Further features of the cleaning tool are described above in relation to the second aspect of the invention.

According to a further aspect of the present invention there is provided a method of drilling and cleaning a well bore on a single trip, comprising the steps:

a) providing a drill string having a drill bit at a first end and including a cleaning tool with selectively activated cleaning members;

b) drilling the well bore by operation of the drill bit while maintaining the cleaning members in a deactivated position; and c) pulling the drill string from the well bore with the cleaning members in an activated position and cleaning the well bore.

Further features of the method are described above in relation to the first aspect of the invention.

According to a still further aspect of the present invention there is provided a downhole cleaning tool for use on a drill string in a well bore, the tool comprising a substantially cylindrical body having a central bore running axially therethrough; a sleeve located within the bore and including a ball seat; mechanical biasing means located between the sleeve and the body to bias the sleeve in a first direction; actuating means upon the sleeve to move a plurality of cleaning members located through the body between an activated and deactivated position with respect to the body; and wherein upon insertion of a drop ball through the central bore in a reverse direction, the sleeve is moved against the mechanical bias such that the cleaning members are activated to extend from the body and contact an interior of a casing wall.

According to a yet further aspect of the present invention, there is provided a drill string comprising:

a drill bit;

a cleaning tool comprising a substantially cylindrical body having a central bore running axially therethrough;

a sleeve located within the bore and including a ball seat; mechanical biasing means located between the sleeve and the body to bias the sleeve in a first direction;

actuating means upon the sleeve to move a plurality of cleaning members located through the body between an activated and deactivated position with respect to the body; and wherein upon insertion of a drop ball through the central bore in a reverse direction, the sleeve is moved against the mechanical bias such that the cleaning members are activated to extend from the body and contact an interior of a casing wall.

Further features of the cleaning tool are described above in relation to the second aspect of the invention.

DESCRIPTION OF THE DRAWINGS

An embodiment of the present invention will now be described, by way of example only, with reference to the accompanying drawings, in which.

DETAILED DESCRIPTION

Figure 1A:
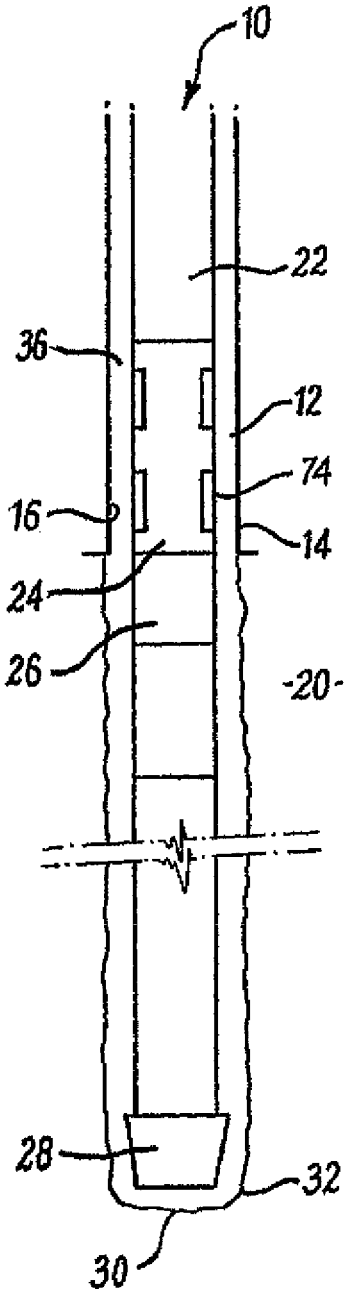
FIGS. 1(*a*) and (*b*) are schematic illustrations of a drill string within a wellbore including a downhole cleaning tool according to an embodiment of the present invention in (a) a deactivated and (b) an activated position.
Figure 1B:
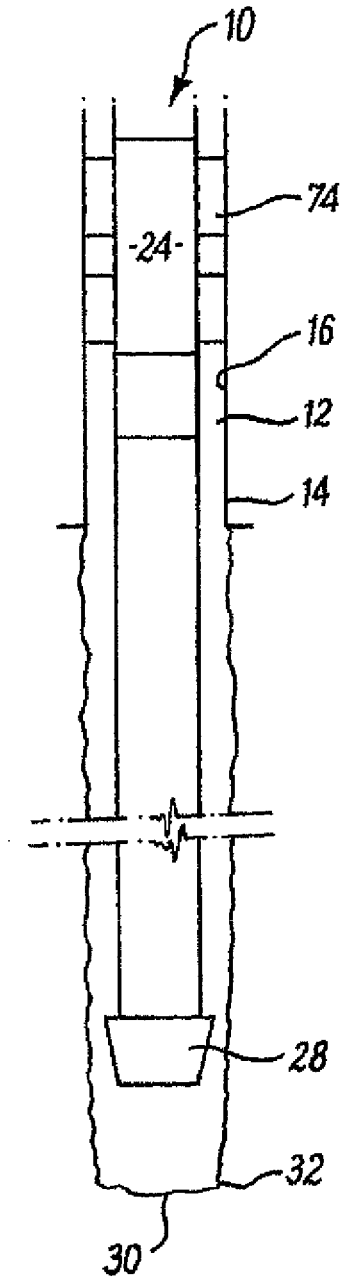

Reference is initially made to FIG. 1(*a*) of the drawings which illustrates a drill string, generally indicated by reference numeral 10, located in a wellbore 12. Wellbore 12 comprises a cased or lined section 14 providing an interior cylindrical wall 16, and an exposed formation 20. Drill string 10 comprises drill stems or pipe sections (only one illustrated) 22, a cleaning tool 24, a ball catcher 26 and a drill bit 28 at an end 30 of the string 10.

FIG. 1 (*a*) shows a typical drilling operation where the string is rotated so that the drill bit 28 cuts away the formation 20 at a base 32 of the wellbore 12. As will be described below, the cleaning tool 24 has cleaning members 74 which remain within the drill string 10 during drilling. This provides a clear annulus 36 between the string t0 and the wall 16 so that drilling fluids with drill cuttings entrained therein can be circulated to the surface of the well.

FIG. 1(*b*) illustrates the drill string 10 upon completion of the drilling operation, where the string 10 is being pulled from the wellbore 12. The cleaning tool 24 has now been activated such that the cleaning members 74 extend from the tool 24 and contact the casing wall 16. As the bit 28 is pulled from the wellbore 12 the cleaning members 74 contact and clean the interior wall 16, to thereby clean the wellbore 12.

Consequently, the wellbore 12 is drilled on run-in and cleaned on pull out, and thus the wellbore 12 is cleaned on the same trip as the wellbore is drilled. Also, by selectively engaging the cleaning members 74 against the wellbore 12, they do not block the flow of drill cuttings during the drilling operation, but can be subsequently activated to engage against the wellbore wall 16 to effectively clean the wellbore wall 16, as the drill string 10 is removed.

Figure 2:
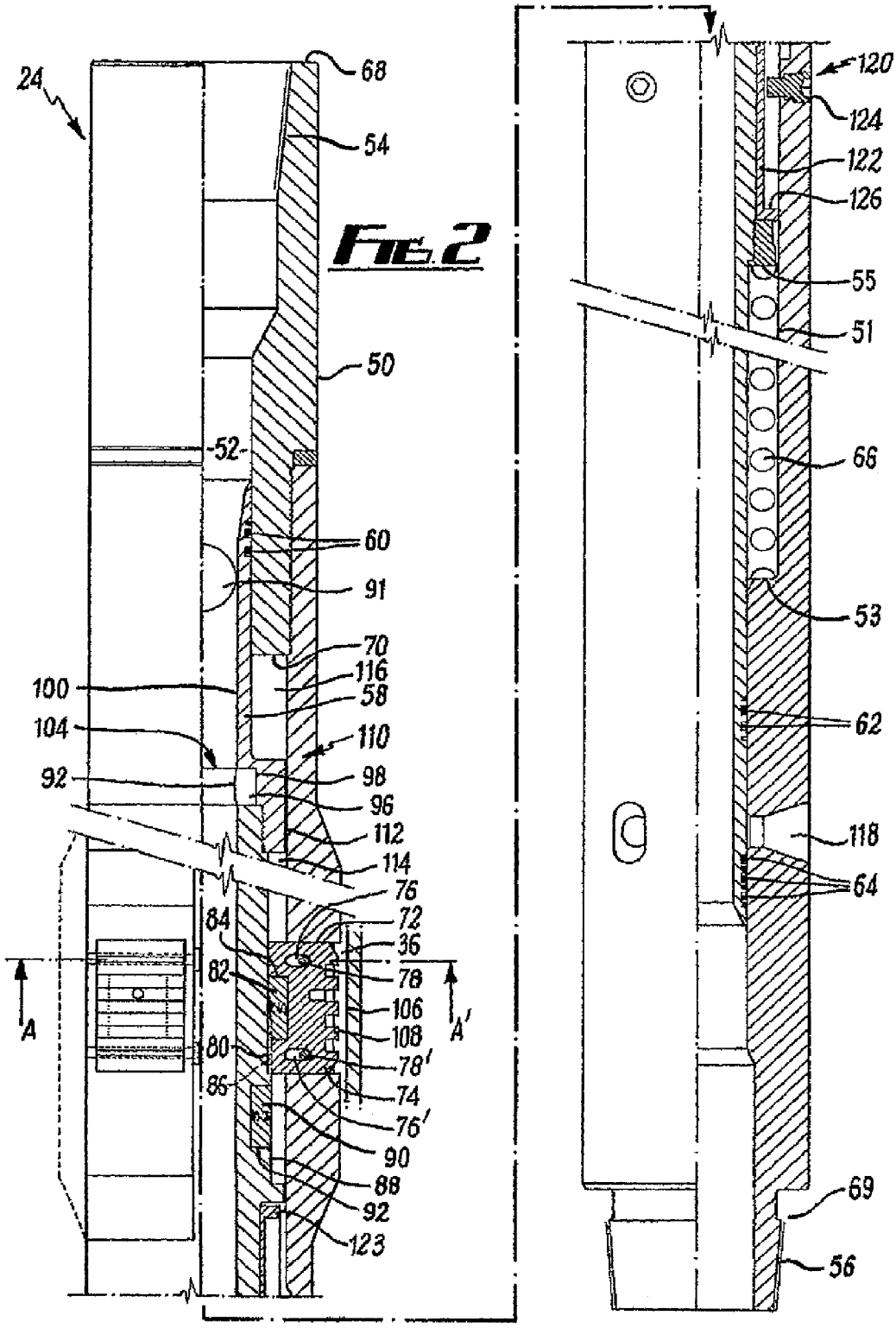
FIG. 2 is an enlarged, detailed, longitudinal half-sectional illustration of the cleaning tool of FIGS. 1(*a*) and 1(*b*), shown in the de-activated position.

Reference is now made to FIG. 2 of the drawings, which is an enlarged, detailed, longitudinal half-sectional view of the cleaning tool 24 shown in FIGS. 1(*a*) and 1(*b*), according to an embodiment of the present invention. The tool 24 comprises a substantially cylindrical body 50 having a central bore 52 extending therethrough, and which provides a fluid circulation path through the tool 24. At an upper end 68, the body 50 has a box section 54 and at a lower end 69 there is a pin section 56, to locate the body 50 within the drill string 10 (not shown in FIG. 2), as is known in the art.

Located within the body 50 is a sleeve 58, which is sealed relative to the body 50 by sets of O-rings 60, 62 and 64. An annular space or channel 51 is defined between the sleeve 58 and the body 50, and is bound by a shoulder 53 on the body 50 and a stop 55 on the sleeve 58. The channel 51 contains a spring 66 arranged to bias the sleeve 58 in a first direction, towards the upper end 68 of the tool 24. The extent to which the sleeve 58 can be moved is limited by a stop 70 on the body 50.

Figure 3:
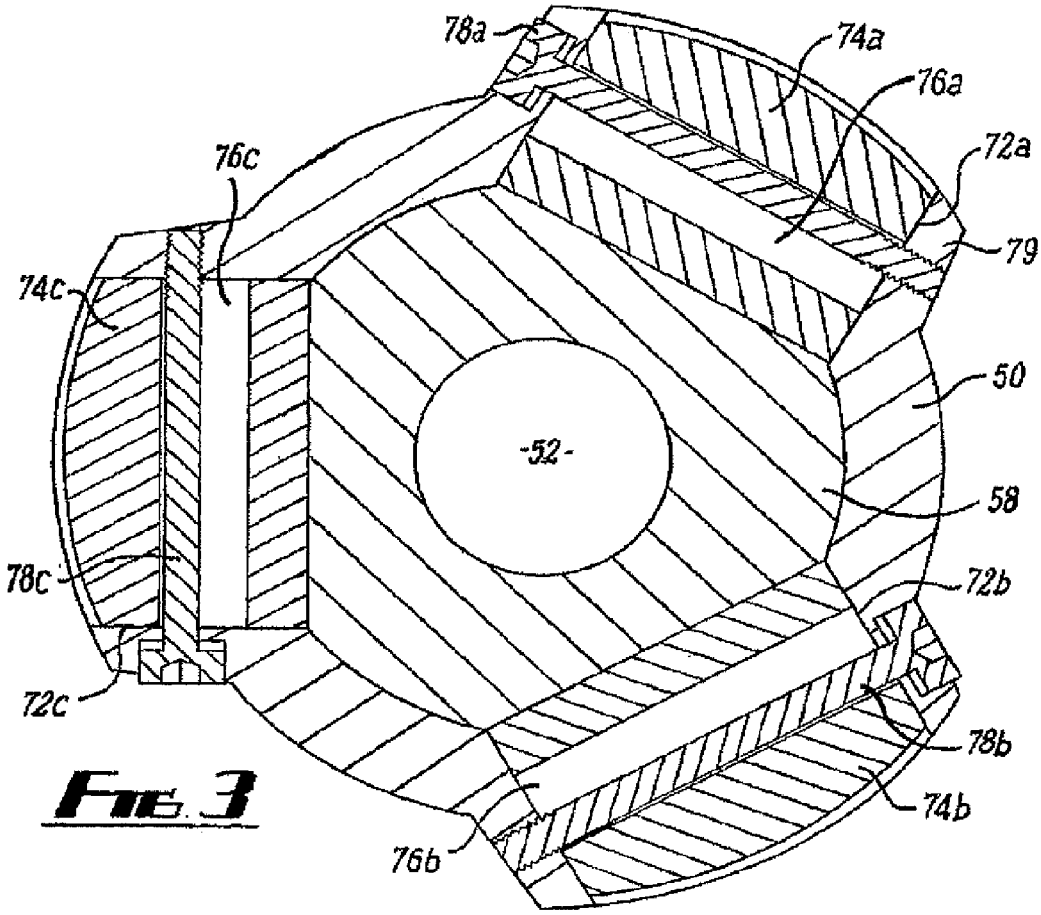
FIG. 3 is a cross-sectional illustration of the tool of FIG. 2 taken about the line A-A'.

A number of sets of apertures (only one illustrated in FIG. 2) 72 are located transversely through the body 50, each set spaced in an axial direction along the length of the body 50. In FIG. 3, which is a cross-sectional view taken about the line A-A' in FIG. 2, it will be noted that there are three such apertures 72 in each set, indicated by suffixes a, b and c. Located through these apertures 72 are corresponding cleaning members or elements 74 which, in the embodiment shown, are scrapers having blades 108. The cleaning members are also given the suffixes a, b and c.

As noted above, there are a number of sets of apertures 72 in the tool body 50, and thus a corresponding number of sets of cleaning members 74, as shown in FIG. 1 (*b*). However, only one such set of cleaning members 74 is shown in FIG. 2. To achieve maximum coverage of the casing wall 16, and thus effective cleaning, the cleaning members 74 of the sets may be circumferentially offset.

It will be appreciated that the elements 74 may take the form of brushes, blades or any other abrasive elements suitable for cleaning the surface 16 of the casing 14 in the wellbore 12. These cleaning elements 74 are not for cutting the casing 14, which should not be damaged in the cleaning operation.

Located through each element 74 are two elliptical bores 76, 76' (FIG. 3), each extending through the cleaning member 74 perpendicular to the central bore 52. The cross-section of each bore 76, 76' is an ellipse to provide for movement of the cleaning elements 74 relative to a retaining bolt or pin 78, 78'. The bolts 78, 78' are located through portions 79 of body 50 which bound the aperture 72. Thus each member 74 is held within the aperture 72 by two bolts 78 (both shown in FIG. 2). Thus the bolts 78 are fixed relative to the body 50, and the members 74 can move relative to the bolts with the bolts located within the elliptical bores 76. In this way the bolts 78 provide a physical restraint to the movement of the members 74 and define the maximum extent to which the members 74 can be extended from the body 50.

Also within each cleaning element 74, located on a back face 80, there is a magnet 82. The magnet 82 is mounted in a recess 84 in the element 74, and an inner surface of the magnet 82 is flush with the face 80. In the embodiment shown, the north pole of the magnet 82 is flush with the face 80. Magnetic attraction initially retains the cleaning elements in the deactivated positions show in FIGS. 2 and 3.

On the sleeve 58 proximate to the elements 74 in each set of elements is a ramp or cam portion 86. This is illustrated by the dotted line on the sleeve 58 in the region of the element 74. The ramp 86 effectively shifts the element 74 radially outwardly as the sleeve 58 is moved upwards in the first direction relative to the body 50. In this way there will be an alignment of the ramp 86 radially inwardly of and thus 'under' the elements 74.

Located on the outer surface 88 of the sleeve 58 are second magnets 90 (one shown). The magnets 90 are also arranged in recesses 92, so that outer surfaces of the magnets 90 sit flush with the outer surface 88 of the sleeve 58, and with their north poles radially outwardly. The magnets 82,90 are arranged so that they can axially align when the sleeve 58 is moved upwardly relative to the body 50.

Movement of the sleeve 58 towards the upper end 68 of the tool 24 causes the ramp 86 to urge the cleaning elements 74 radially outwardly, thereby mechanically extending the cleaning elements through their apertures 72 towards the wall 16 of the wellbore. Further upward movement of the sleeve 58 is restricted by the stop 70 and, in this position, the magnets 82, 90 are axially aligned. As identical poles of the magnets are facing each other they will automatically repel each other providing a "magnetic levitation" (repulsion), when the magnets are aligned. This mutual repulsion between the magnets 82, 90 will bias the elements 74 away from the sleeve 58 and the tool 24, to provide maximum contact of the scrapers 108 of the elements 74 against the wall 16.

The magnets are made of samarium cobalt, though other materials with suitable properties may be selected. Advantageously, the material of the sleeve 58 is selected so that the first magnet 82 positively retains the element 74 against the sleeve 58 until the two magnets 82, 90 are brought together.

Located within the bore 52 is a ball seat 96, which is mounted in a recess 98 formed in an inner surface 100 of the sleeve 58. Ideally the ball seat 96 is as described in International Patent Application PCT/GB2005/001662 to the Applicant. In this embodiment the ball seat 96 is elastically deformable, and is typically made of a material such as PEEK (polyetheretherketone). It will be recognised, however, that other polymeric materials with suitable elastic properties could be utilised.

A ball or plug 91 is dropped through the bore 52 and locates on an upper edge 92 of the seat 96. The ball 91 then seals the bore, and when sufficient pressure builds up on the ball, the ball compresses the seat 96. The material of the seat 96 is selected such that compression reduces the volume of the seat. A throughbore 104 of the seat 96 thus increases radially to provide the sufficient clearance. The material of the ball seat is also selected such that when a plug or ball passes through the seat, the seat 96 will return to its original shape and volume shown in FIG. 2. In this way multiple identical balls can be dropped through the seat 96.

The seat 96 of this embodiment is described herein as being of an elastic, optionally polymeric material. The balls 91 or plugs will then be a solid material such as steel. It will be recognised that the seat itself could be made of a harder material (such as steel) and that the balls 91 or plugs could be of a deformable material. The requirement is simply that the plug sits on the seat for a sufficient length of time to allow pressure to build up behind the plug in order to push the sleeve 58 down against the spring 66, before the increased pressure causes the ball 91 to pass through the seat and be expelled from the tool 24. As will be described below, it is this movement of the sleeve 58 which facilitates movement of the cleaning members 74 to their activated positions.

Other features of the tool 24 will now be described. The first of these is a damper generally indicated by reference numeral 110, which prevents bounce when the sleeve 58 moves against the spring 66. The damper 110 consists of an annular gap or spacing 112 located between a chamber 114 which the apertures 72 open on to, and a chamber 116 defined between the body 50, the stop 70 and the sleeve 58. The spacing 112 provides for the inflow and outflow of fluid in a controlled manner from and to the chamber 114 as movement of the sleeve 58 is effected.

Also located through the body 50 are one or more radial flow ports 118. These radial ports 118 provide for the expulsion of fluid from the bore 52 of the tool 24 when the sleeve 58 is fully biased by the spring 66. In this way the sleeve 58 is moved from an obturating position where it closes the ports 118, so that a free passageway exists between the bore 52 and the ports 118. In this position, fluid can be used to assist in moving cuttings or other material in the annulus 36 between the tool and the wellbore wall 106. It will be appreciated that the ports 118 may be directed (eg. inclined) to enhance the jetting nature of the fluid and they may also include nozzles and/or attachments to increase the effectiveness of the jetting as required. It will also be appreciated that, in another embodiment, there could equally be a port located through the sleeve 58 such that when the port within the sleeve 58 is aligned with the ports 118 in the body, the expulsion of fluid through the tool is effected. It is noted that the ports 118 are located below the cleaning elements 74. This effectively means that fluid flushed from the ports 118 is used to clear the material which has just been scraped from the wellbore wall 16 as the tool 24 is removed from the wellbore 12.

Figure 4A:
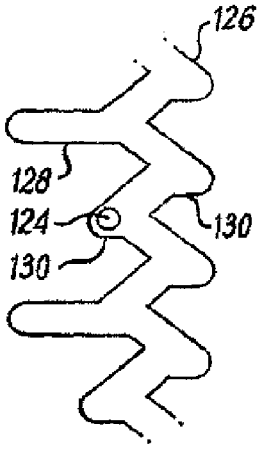
FIGS. 4(*a*)~(*c*) are schematic illustrations of an engagement mechanism forming part of the cleaning tool of FIG. 2.
Figure 4B:
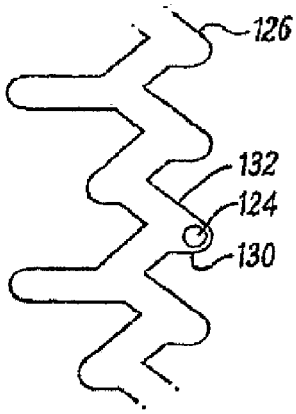
Figure 4C:
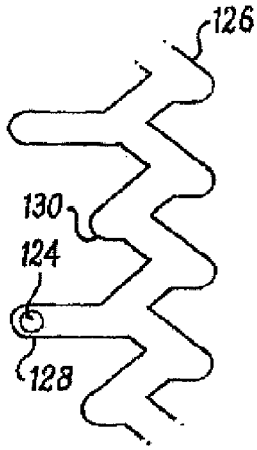

A yet further feature of the tool 24 is an engagement mechanism, generally indicated by reference numeral 120, which couples the sleeve 58 to the body 50 and controls relative movement therebetween. A part of the mechanism 120 is illustrated in FIGS. 4(*a*)-(*e*), which are opened-out views of an index sleeve 122 mounted on the sleeve 58, and a matching index pin 124 located through the body 50. Although only one index pin 124 is illustrated, the tool 24 would typically have three or more pins to distribute load over the mechanism. The index sleeve 122 is rotatably mounted on the sleeve 58, but is restrained against axial movement relative to the sleeve 58 by a sleeve shoulder 123 and the stop ring 55. Index sleeve 122 includes a profiled groove or can track 126 on an outer surface 128, in which the index pin 124 locates.

As shown in FIGS. 4(*a*)-(*c*), the groove 126 extends circumferentially around the sleeve 122, and consequently the groove 126 provides a continuous path. The groove 126 path has a zigzag-type profile to provide for axial and rotational movement of the sleeve 58 relative to the body 50. The spring 66 biases the sleeve 58 against the index pin 124. The groove 126 includes an extended longitudinal portion 128 which defines a detent at every second lower apex of the track. Further stops or detents 130 are located at upper apexes 132 of the track to encourage the index pin 124 to remain at the apexes and provide a locking function to the tool 24. The stops 130 are provided in the direction of rotational travel of the pin 124 along the groove 126.

In use, the tool 24 is connected to a drill string 10, using the box section 54 and pin section 56, together with the ball catcher 26 and the drill bit 28, as illustrated in FIG. 1(*a*). When located on the drill string, the tool 24 is arranged in a first position, as shown in FIG. 2. In this position, the spring 66 biases the sleeve 58 against the index pin 124 such that the pin 124 is located within a stop 130, between the longitudinal apexes 128 of the groove 126, as illustrated in FIG. 4(*a*). In this first axial position of the sleeve 58 relative to the body 50, the magnets 82 hold the elements 74 against the surface 86 of the sleeve 58 such that the elements 74 are retracted or disengaged from the wellbore wall 16. As shown in FIG. 2, in this position, the scrapers 108 sit flush with the outer surface of the body 50. The scrapers 108 thus do not interfere with the running of the tool in this configuration. Also, the sleeve 58 covers the port 118 so that all fluid in the drill string passes through the bore 52 to the drill bit 28.

The drill string 10, including the drill bit 28 and the cleaning tool 24, is then run into the wellbore 12 to the end of the well 30 where drilling using the drill bit 28 takes place. During drilling, mud is circulated through the bore 52 to the drill bit 28, and returns up the annulus 36 defined between the string 10 and the wellbore wall 16. This passage of fluid assists in lifting the cuttings created by the drill bit 28 from the well. It will be appreciated that motors driven by the circulating mud can be located behind the drill bit in order to drive the drill bit, as is known in the art.

When it is decided to stop drilling and lift the drill bit 28 from the wellbore, the ball 91 (or other plug) is dropped into the bore 52. The ball travels to the seat 96 whereupon it blocks the passage of fluid downwards through the string 10 in the bore 52. By blocking the passage of fluid, pressure builds up behind the ball thereby exerting a fluid pressure force upon the sleeve 58. This pressure force is transmitted to the spring 66, compressing the spring such that the sleeve 58 moves downwards. Such movement carries the index sleeve 122, which is rotated such that the pin 124 locates in the apex 132. This is called the intermediate or 'primed' position of the tool. In this position the ramp 86 and the elements 74 are axially separated, and the magnets 82 hold the elements against the sleeve 58, in their deactivated positions.

As pressure increases on the ball 91, it is blown through the ball seat 96, by compression of the ball seat within its own volume, and the ball seat then returns to its original, undeformed configuration. The ball 91 travels out of the tool 24 and into the ball catcher 26 located therebelow. Any suitable ball catcher may be used. An example of one is given in International Patent Application WO 2004/094779 to the Applicant. This ball catcher provides a side path for the balls to be retained while maintaining a central clearance bore through the tool for the passage of fluid and/or other tools.

When the ball 91 passes through the seat 96, the fluid pressure force acting on the spring 66 reduces and consequently the sleeve 58 is forced upwards against the index pin 124, thereby rotating the index sleeve 122. The index pin 124 then resides in the long apex 128. This is referred to as the second position or 'engaged' position. It may also be referred to as the energised position as, during movement of the sleeve 58, the elements 74 pass up the ramp 86 causing the magnets 82, 90 to axially align. Alignment of the magnets 82, 90 causes magnetic levitation (repulsion), so biasing the elements 74 outwardly from the tool 24. Movement of the elements are thus provided in two ways. Firstly by the physical movement as the ramp 86 moves upwardly, urging the elements 74 outwardly; and secondly by the radial biasing from magnetic levitation when the magnets 82, 90 align and repel each other.

The elements 74 are now held against the casing wall 106, and by translation of the tool 24 relative to the wellbore 12, the scrapers 108 clean the wellbore wall 16. Due to the length of the apex 128, the tool 24 remains effectively locked in this position as any minor fluctuations in axial movement between the sleeve 58 and the body 50, will not cause the pin 124 to escape from the apex 128.

Movement of the sleeve 58 to the energised position also uncovers the ports 118. Thus fluid pumped down the string 10, when the tool 24 is cleaning the wellbore wall 16, exits from the bore 52 through the ports 118, to impact upon the scraped surface 16 to further enhance the cleaning and removal of debris from the wellbore 12. This expulsion of fluid will be detected as a drop in mud pressure at the surface of the well, and can be used as an indicator that the sleeve 58 has moved to the energised position and that the elements 74 are activated.

If the wellbore surface 16 does not require to be cleaned as the tool 24 is removed, the elements 74 can be retracted by dropping a further ball (not shown), and cycling the sleeve 52 back to the first position shown in FIG. 2, where the pin 124 resides in the apex 132. Such portions of the wellbore where cleaning is not required may be at seals, nipples etc. where the action of the scrapers could damage these parts. Once the elements 74 have cleared such parts, the tool can be reactivated by dropping a still further ball (not shown) through the string 10.

This resetting may additionally be required if it is decided that the drill bit 28 should be reinserted deeper within the well, such that the element 74 would reach past the end of the last casing section. Here, if the elements could not be retracted, they would cause the tool to jam by contact on the casing section when the string is pulled-out. When the elements 74 are required to be retracted, a further ball (not shown) may be dropped through the bore 52. This will contact the ball seat 96 and the resulting increase in fluid pressure moves the sleeve 58 back to the energised position within the apex 132. As the ball is forced through the seat (with the increase in fluid pressure), the index sleeve 122 again rotates so that the pin 124 resides in the first position of FIG. 4(*a*). The magnets 82, 90 have thus been forced apart and the first magnet 82 will now contact the surface 94 of the sleeve 58 and hold the elements 74 back in their retracted positions. By dropping further balls through the tool the cleaning element 74 can be engaged and disengaged any number of times. The maximum number of times may be dependent upon the capacity of the ball catcher.

Figure 5A:
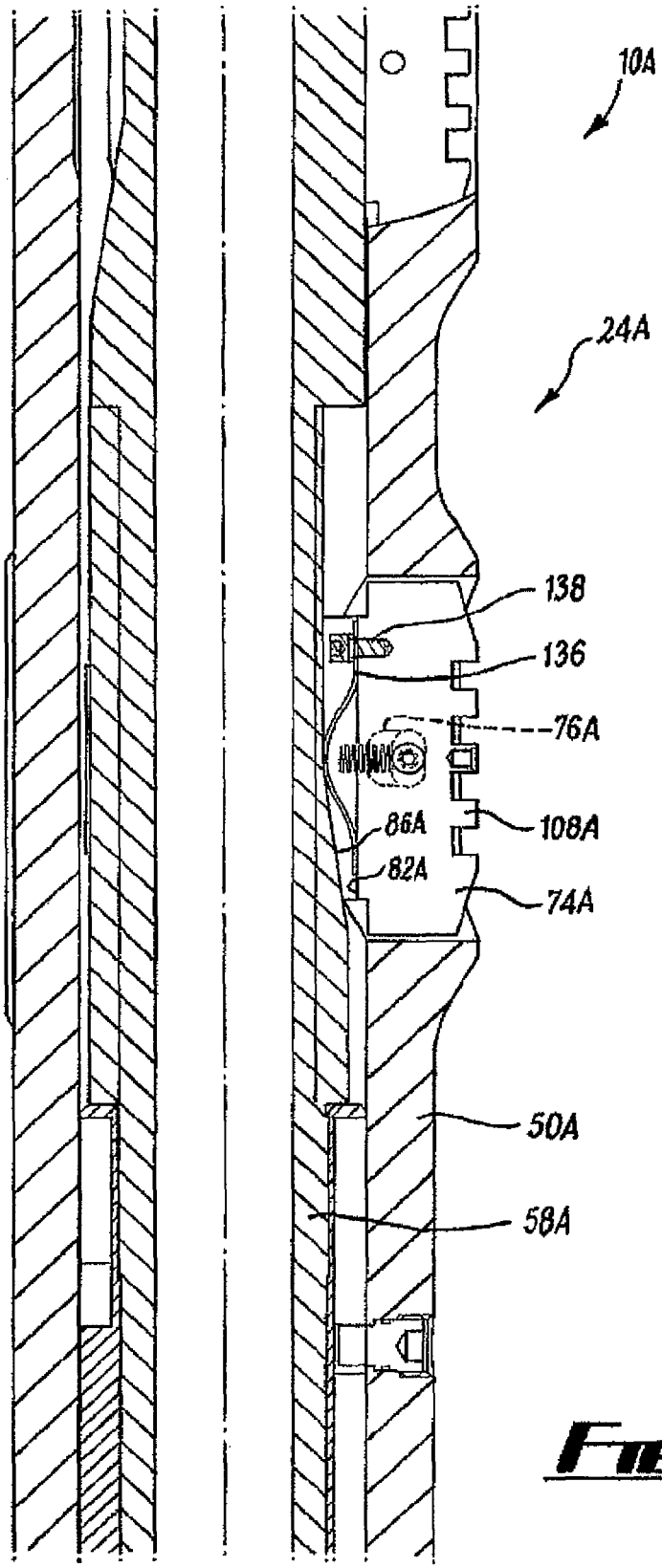
FIGS. 5(*a*) and 5(*b*) are detailed, longitudinal half-sectional illustrations of part of a cleaning tool in accordance with an alternative embodiment of the present invention in (a) a deactivated and (b) an activated position.
Figure 5B:
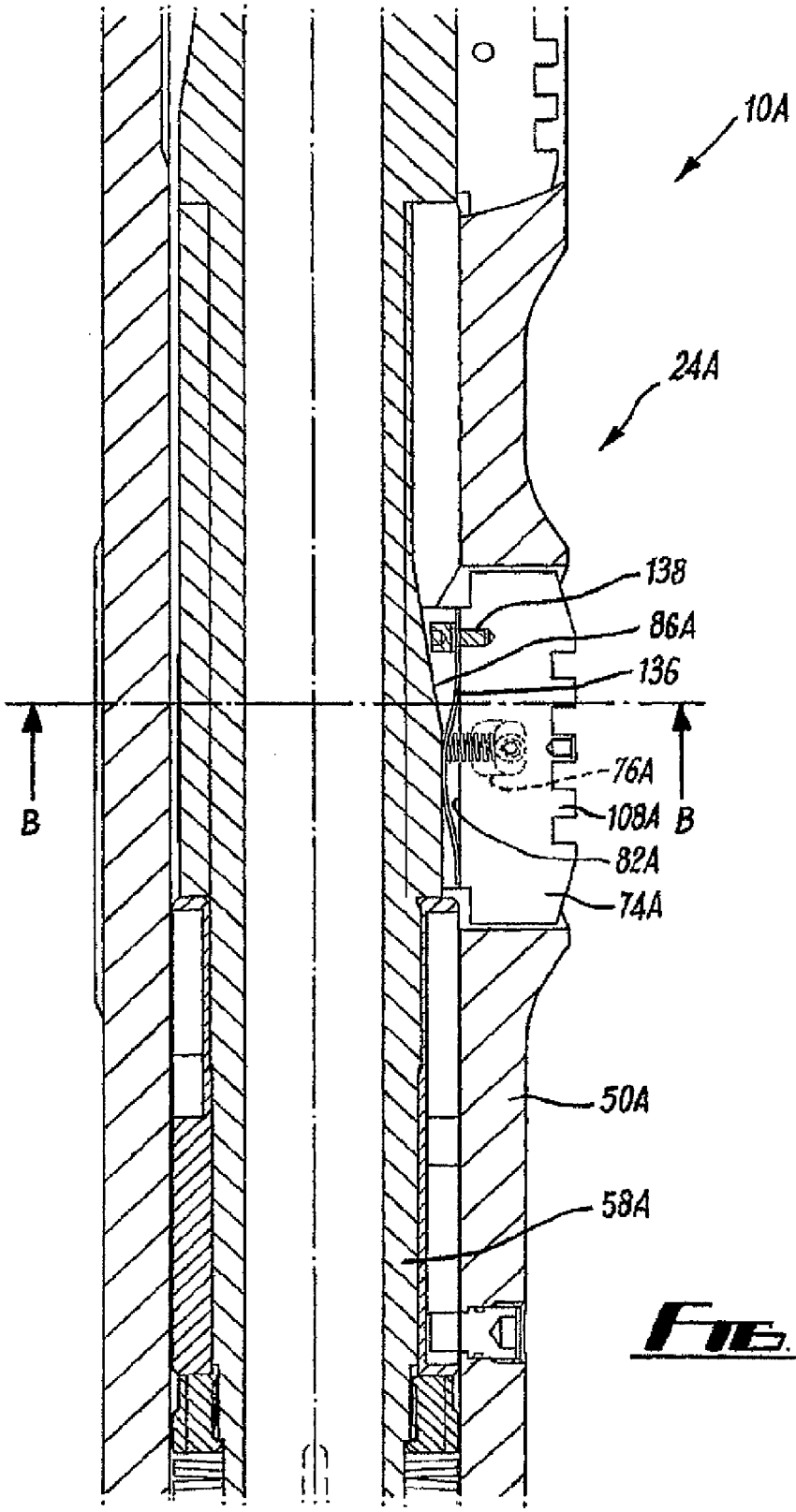

Turning now to FIGS. 5(*a*) and 5(*b*), there are shown detailed, longitudinal half-sectional views of part of a cleaning tool in accordance with an alternative embodiment of the present invention, the cleaning tool indicated generally by reference numeral 24A. Like components of the cleaning tool 24A with the cleaning tool 24 of FIGS. 1(*a*) to 4(*c*) share the same reference numerals, with the addition of the suffix 'A'. Only the substantive differences between the tool 24A and the tool 24 of FIGS. 1(*a*) to 4(*c*) will be described herein.

Figure 6:
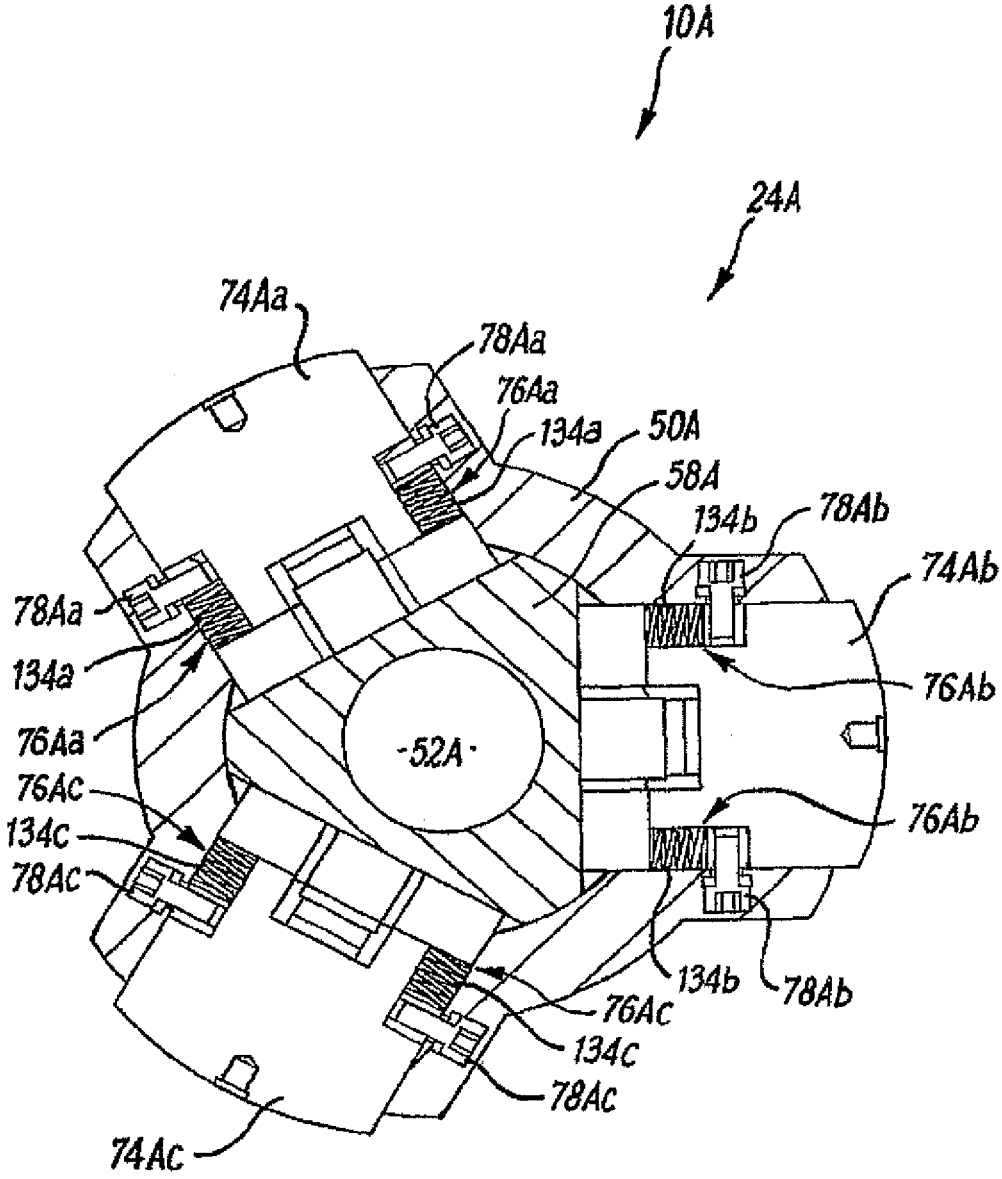
FIG. 6 is a cross-sectional illustration of the tool of FIGS. 5(*a*) and 5(*b*), taken about line B-B of FIG. 5(*b*).

The tool 24A includes cleaning elements 74A, one shown in FIGS. 5(*a*) and 5(*b*), having scraper blades 108A. The tool 24A is shown in a deactivated position in FIG. 5(*a*) and in an activated position in FIG. 5(*b*). As shown in FIG. 6, which is a cross-sectional view of the tool 24A taken about the line B-B of FIG. 5(*b*), it will be noted that three such cleaning elements 74Aa to 74*c* are provided, each mounted for movement relative to a body 50A of the tool 24A by pairs of restraining bolts 78A, each bolt located through apertures 76A. It will be appreciated that a number of axially spaced sets of cleaning elements 74A are provided, in a similar fashion to the tool 24. Springs 134 are located in the apertures 76A, and normally bias the cleaning elements 74A to their retracted positions of FIG. 5(*a*).

In place of the magnets 82, 90 of the cleaning tool 24, each cleaning element 74A includes a wave spring 136, which is mounted on a rear surface 82A of the respective cleaning elements 74A by a bolt 138. When a sleeve 58A is moved upwardly by locating a drop ball on a valve seat (not shown), in the fashion described above, a ramp 86A on the sleeve 58A acts to urge the cleaning elements 74A radially outwardly against the biasing force of the springs 134, and deforms the wave spring 136. This urges the cleaning elements 74A radially outwardly into contact with a wall of a wellbore, such as the wall 16 of the casing 14 located in the wellbore 22 shown in FIG. 1(*a*). A drill string 10A carrying the cleaning tool 24A is then translated relative to the wellbore wall 16 in an uphole direction (towards the surface), for cleaning the wellbore. The sleeve 58A is cycled between various axial positions, controlled using drop balls, for selectively extending and retracting the cleaning elements 74A, in the fashion described above in relation to the cleaning tool 24. When the sleeve 58A is urged downwardly, towards the position shown in FIG. 5(*a*), the cleaning elements 74A are returned to their retracted, deactivated positions by the springs 134.

It will be appreciated that although the description refers to relative positions as being "above" and "below" and terms such as "up" and "down" have been used, the tool and method presented in the present invention can equally be used in horizontal and inclined well bores and is not restricted to vertical boreholes. Thus the terms above and up may refer to an uphole location or movement, whilst below or down may refer to a downhole location or movement.

A principal advantage of the present invention is that it provides a method of drilling and cleaning a wellbore on a single trip into a wellbore. A further advantage of the present invention is that in performing the single trip, it does not leave the formation of the wellbore exposed for an excessive length of time, as would be required if a second trip was needed into the wellbore.

A further advantage of the present invention is that the cleaning members can selectively be actuated and deactivated independently of the drilling or fluid pressure through the tool. In particular, when the tool is deactivated and the cleaning members are moved back into the body this prevents any snagging on pull out of the tool. Additionally the ports can be closed to pull the tool through the drill string faster, and by disengaging the scrapers, the tool will be pulled out faster once the cleaning operation has been completed. Various modifications may be made to the invention herein described without departing from the scope thereof.

For example, whilst the drill string is described as being rotated (from surface) to drive and rotate the drill bit, it will be understood that the drill string may comprise a downhole motor such as a PDM or a turbine for driving the bit.

The magnet on the sleeve, used for urging the cleaning members to their activated positions, may be annular in shape; alternatively, a number of separate, arcuate magnets may be provided.

The invention claimed is:

1. A tool comprising:

a body having a bore running therethrough;

a sleeve located within the bore, the sleeve including a ball seat and the sleeve being biased in a first direction; and a plurality of selectively activatable cleaning members mounted for repeated movement relative to the body between activated and deactivated positions;

wherein location of a ball on the ball seat facilitates movement of the sleeve in a second direction opposite to said first direction, to in turn facilitate movement of the selectively activatable cleaning members to activated positions where the selectively activatable cleaning members contact a wellbore wall.

2. The tool as claimed in claim 1, wherein the selectively activatable cleaning members are located in apertures extending through a wall of the body.

3. The tool as claimed in claim 1, wherein the tool is configured to be actuated by inserting the ball into the bore of the body, the ball passing into and along the bore in a reverse direction.

4. The tool as claimed in claim 1, wherein the sleeve is movable relative to the body between a first axial position in which the selectively activatable cleaning members are in respective deactivated positions, and a further axial position in which the selectively activatable cleaning members are in respective activated positions.

5. The tool as claimed in claim 4, wherein location of a ball on the ball seat serves for moving the sleeve between the first and further axial positions, to thereby move the selectively activatable cleaning members to respective activated positions.

6. The tool as claimed in claim 4, wherein the sleeve is movable relative to the body in said further axial direction, from the first axial position to an intermediate axial position, during movement from the first axial position to the further axial position.

7. The tool as claimed in claim 6, wherein the sleeve is biased for movement from the intermediate axial position towards the further axial position.

8. The tool as claimed in claim 4, wherein the tool further comprises a track on one of the sleeve and the body, and at least one follower on the other one of the sleeve and the body, and wherein the follower is configured to engage within the track to facilitate control of movement of the sleeve relative to the body.

9. The tool as claimed in claim 8, wherein the track extends at least part way around a surface of the respective one of the sleeve and the body.

10. The tool as claimed in claim 9, wherein the track defines a plurality of detent positions spaced around the surface of the respective one of the sleeve and the body.

11. The tool as claimed in claim 10, wherein the track defines at least one detent position corresponding to each axial position of the sleeve relative to the body.

12. The tool as claimed in claim 1, wherein the selectively activatable cleaning members are radially biased.

13. The tool as claimed in claim 1, wherein the ball seat is configured to releasably retain the ball, and wherein the ball seat is of a deformable material.

14. The tool as claimed in claim 1, wherein the body includes at least one port extending therethrough.

15. A drill string comprising:

a drill bit; and a downhole cleaning tool comprising a body having a bore running therethrough;

a sleeve located within the bore, the sleeve including an elastically deformable ball seat and the sleeve being biased in a first direction; and a plurality of cleaning members mounted for movement relative to the body between activated and deactivated positions;

wherein the sleeve further comprises an index sleeve rotatably mounted on the sleeve and the body comprises a matching index pin located through the body for coupling the sleeve to the body.

16. The drill string of claim 15, wherein the index sleeve comprises a track in which the index pin is located.

17. The drill string of claim 16, wherein the track extends circumferentially around the index sleeve to provide for axial and rotational movement of the sleeve relative to the body.

* * * * *